United States Patent [19]

Weglage

[11] 4,172,523

[45] Oct. 30, 1979

[54] APPLICATOR FOR RETAINING RINGS

[75] Inventor: David E. Weglage, Dayton, Ohio

[73] Assignee: Walter Becker, Kettering, Ohio ; a part interest

[21] Appl. No.: 800,703

[22] Filed: May 26, 1977

Related U.S. Application Data

[63] Continuation of Ser. No. 627,700, Oct. 31, 1975, abandoned, which is a continuation of Ser. No. 502,923, Sep. 4, 1974, abandoned, which is a continuation-in-part of Ser. No. 396,841, Sep. 13, 1973, Pat. No. 3,846,900, which is a continuation of Ser. No. 233,137, Mar. 9, 1972, abandoned.

[51] Int. Cl.[2] ..... B65D 85/24

[52] U.S. Cl. ..... 206/338; 206/230; 206/343; 221/307

[58] Field of Search ..... 29/413; 206/338, 340, 206/341, 343; 221/312 R, 312 C, 303, 307, 310, 308, 289, 294; 10/162 S

[56] References Cited

U.S. PATENT DOCUMENTS

| | | | |
|---|---|---|---|
| 1,385,086 | 7/1921 | Maranville | 221/307 |
| 1,439,918 | 12/1922 | Smith | 206/338 |
| 1,671,809 | 5/1928 | Briggs | 206/340 |
| 2,481,495 | 9/1949 | Borthwick | 221/310 |
| 3,164,249 | 1/1965 | Paxton | 206/343 |

*Primary Examiner*—Robert J. Spar

*Assistant Examiner*—H. Grant Skaggs

*Attorney, Agent, or Firm*—Becker & Becker, Inc.

[57] ABSTRACT

An applicator for use in connection with a retaining ring supply, which comprises a plurality of retaining rings detachably connected to each other so as to form a strip. The applicator is in the form of a sheath having a flat passage therethrough extending in the longitudinal direction of the sheath and being dimensioned to slidably receive and guide therethrough a strip of retaining rings. The strip has at least one window in at least one of its wide sides, which window leads from the outside surface of the sheath into the flat passage and is so dimensioned as to permit a finger, for instance, a thumb of a person to pass through said window easily and to engage a strip of retaining rings in said sheath to selectively advance the same by one ring at a time, so as to have one ring at a time project from one end of the applicator. According to a particularly advantageous feature, adjacent to the last mentioned applicator end there is provided a tongue-shaped spring which extends from said one end in longitudinal direction of the sheath and has that end portion which is adjacent the mentioned applicator end slightly and yieldably extending into the passage through the applicator for catching behind that retaining ring which has been projected out of the applicator to prevent the last mentioned ring from being pushed back into the applicator.

1 Claim, 8 Drawing Figures

FIG-1
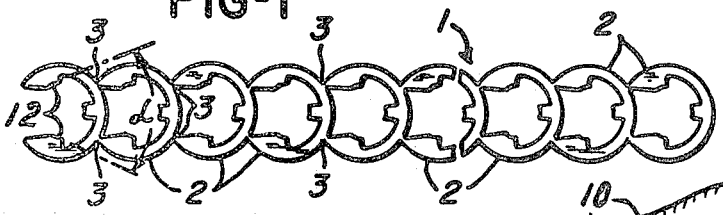
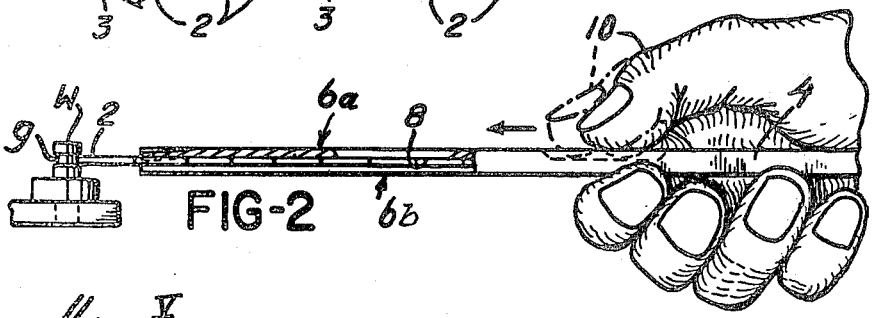
FIG-2
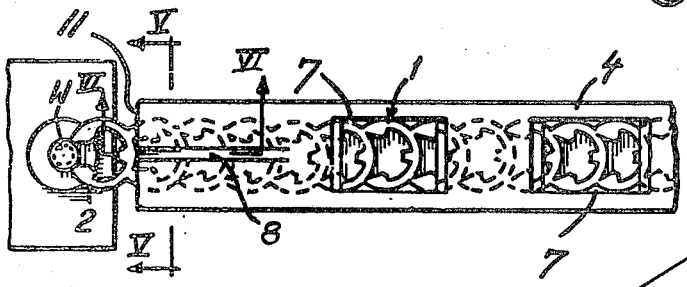
FIG-3
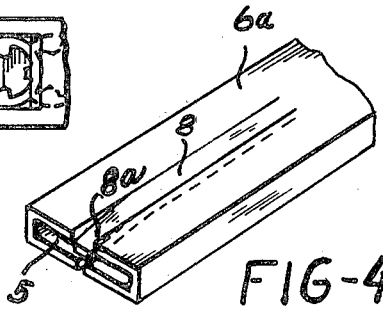
FIG-4
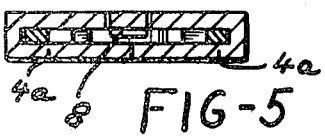
FIG-5
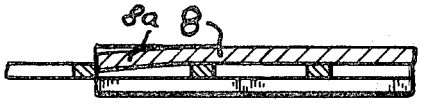
FIG-6
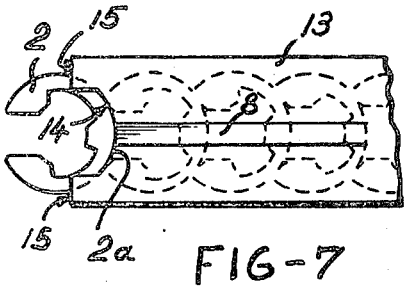
FIG-7
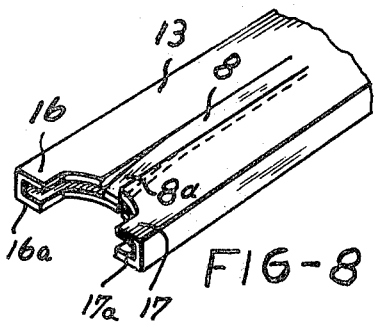
FIG-8

APPLICATOR FOR RETAINING RINGS

This is a continuation application of Ser. No. 627,700 filed Oct. 31, 1975, now abandoned being a continuation of Ser. No. 502,923 filed Sept. 4, 1974, now abandoned which in turn is a continuation-in-part application of continuation application Ser. No. 396,841 filed Sept. 13, 1973 (now U.S. Pat. No. 3,846,900 issued Nov. 12, 1974) of original application Ser. No. 233,137 filed Mar. 9, 1972, now abandoned.

In my co-pending Application Ser. No. 396,841, now U.S. Pat. No. 3,846,900 which is a Continuation Application of my Application Ser. No. 233,137 (now abandoned) there is described a device or applicator for manually holding a portion of a retaining ring supply and for advancing a portion of said supply so as to apply one retaining ring at a time to a workpiece.

It is an object of this invention further to improve the above mentioned device or applicator to facilitate the handling thereof.

It is another object of this invention to provide the application set forth in the preceding paragraph with means which, once the foremost retaining ring protrudes from the applicator to a sufficient extent making its insertion into the workpiece possible, will automatically prevent said foremost retaining ring from being pushed back into the applicator.

It is still another object of this invention so to design the applicator set forth in the two preceding paragraphs that the foremost retaining ring to be inserted into a workpiece will, while protruding from the applicator, still be laterally supported.

These and other objects and advantages of the invention will appear more clearly from the following specification in connection with the accompanying drawing, in which:

FIG. 1 shows a top view of a retaining ring supply for use in connection with the applicator according to the present invention.

FIG. 2 illustrates partly in view and partly in section an applicator according to the invention with a retaining ring supply of FIG. 1 and also shows the mode of applying a retaining ring to a workpiece.

FIG. 3 is a top view of the left hand portion of FIG. 2.

FIG. 4 is an isometric view of the front portion of the applicator according to the present invention.

FIG. 5 is a section taken along the line V—V of FIG. 3.

FIG. 6 is a section taken along the line VI—VI of FIG. 3.

FIG. 7 illustrates a top view of a modification of the applicator of FIGS. 1-6 as to the front portion of the applicator.

FIG. 8 is an isometric view of the front portion of the applicator of FIG. 7.

The applicator according to the present invention which is in the form of a sheath with a flat passage therethrough conforming in cross sectional dimension to the maximum width of said strip of retaining rings and has at least one window in one of its major surfaces for passing an actuating finger of a human hand therethrough is characterized primarily in that the front end portion of the applicator has lanced out a narrow tongue which extends to the front end of the applicator and has its front end slightly bent or curved into the passage through the sheath for automatically catching behind the foremost retaining ring of a strip of retaining rings in the sheath when said foremost retaining ring has projected from the front end comprising the outlet opening representing the dispensing end of the applicator, so as to prevent the projecting ring from accidentally being pushed back into the applicator.

While the sheath according to the invention works satisfactorily when the front end of the sheath is straight, it has proved advantageous with some sizes of retaining rings to support the projecting foremost retaining ring on its sides while the ring is being pushed into a groove in the workpiece. Therefore, according to another feature of the present invention the front end of the sheath has a central area cut out along an arc and preferably curved in conformity with the outer curved contour of each of the retaining rings and has forwardly projecting arms adjacent the ends of said curved contour so that the foremost retaining ring can be exposed in its projecting position while its side parts are still supported by the front sheath portion on both ends of said arc.

Referring now to the drawing in detail, FIG. 1 shows a supply band or strip 1 of retaining rings 2 which may be of any standard type and may be of steel or plastic material. The retainer rings specifically shown in the drawing merely by way of example are so-called E-rings. As will be seen from FIG. 1, each two retainer rings are connected to each other along narrow sections 3 so that the retainer rings (also called retaining rings) form with each other a strip or band 1. Advantageously, the rings of strip 1 are applied to a workpiece W by means of an applicator 4 which will presently be described. The applicator 4 is in the form of a sheath having two relatively narrow side walls and two relatively wide transverse walls (FIGS. 5, 6 and 8) interconnecting said side walls so as to form a guiding passage 5 for the strip of retaining rings to be received in the applicator, with just sufficient play to permit a smooth sliding movement of the strip in the passage 5 of the applicator 4. One or both of said transverse walls (in the drawing shown as top and bottom walls *6a* and *6b* respectively) are provided with at least one window 7. The window or windows are so dimensioned as to permit a finger, e.g. the thumb, of a human hand to pass through the window for engagement with a strip of retaining rings in the passage 5 of the applicator.

The front end portion of the applicator has lanced out a narrow tongue 8 the rear portion of which is integrally connected to one of the transverse walls *6a* or *6b* while the front end of said tongue is slightly bent inwardly into the passage 5. The remaining rear portion of the tongue 8 is normally flush with the adjacent pertaining surface *6a* or *6b* of the applicator. The tongue 8 forms a spring which while being able to yield so as to allow the respective foremost ring of a retainer ring strip in the applicator to slip out of the applicator below the bent front end *8a* and immediately after said foremost ring has slipped out underneath the bent end *8a* of the spring, will spring back and behind said slipped out foremost ring so as to prevent the latter from slipping back into the sheath. In this way it is not necessary to hold the strip with a finger for instance the thumb of a hand through the window pressed down in the passage so that the front ring or foremost ring cannot slip back into the applicator when the applicator with the foremost retaining ring projected is pushed toward the workpiece into which the foremost retaining ring has to be inserted. It may also be mentioned that the front end piece 8*a* of the tongue 8 preferably, but not necessarily, is slightly concave in conformity with the curvature of the retaining ring rear portion to be engaged by said end face.

The operation and handling of the applicator is as follows: assuming that each of a plurality of workpieces or pins W (one only being shown in FIG. 2) is to be provided with a retaining ring 2 which to this end is to be inserted into a groove 9 on pin W. The operator by means of his thumb 10 passed through the adjacent window 7 engages the strip 1 and advances the same so that, as shown in FIGS. 2 and 3, a retaining ring 2 projects from the adjacent or foremost end 11 which represents a dispensing end of the applicator 4. While the foremost retaining ring was advanced it slipped below the tongue 8 while lifting the bent end 8*a* slightly. As soon as the foremost retaining ring has passed below the bent end 8*a* of tongue 8, the tongue springs back with the bent end 8*a* behind the rearmost end of the foremost retaining ring now projecting from the applicator as shown in FIGS. 2, 5, and particulary clearly in FIG. 6, thereby preventing said projecting foremost retaining ring from being pushed back into the applicator by any force acting upon the projecting ring in the direction opposite to its previous advancing direction. With the foremost ring now projecting from the applicator, the operator pushes the applicator toward the workpiece so as to press the projecting retaining ring into the groove 9 into which said foremost retaining ring snaps, particularly when the ring is provided with the commonly known inclined ring surfaces 12 forming with each other an angle $\alpha$ for instance of 45°. When with regard to FIG. 3 the applicator is now tilted vertically out of the drawing plane, the retaining ring straddling the pin 9 will break and detach itself from the next following retaining ring along the ares of the narrow section 3. The operator then takes the applicator to the next pin 9 (not shown) to repeat the operation described above.

From the above, it will be evident that the present invention not only totally eliminates the heretofore necessary stacking of the individual retaining rings but also eliminates the use of an applicator for individually transferring each individual retaining ring from the stacked supply of retaining rings to the workpiece and consequently eliminates the difficulties occurring when with heretofore known arrangements, retaining rings stick together or assume an inclined position. Also the possibility that retaining rings accidentally drop off an applicator during the intended transfer from the stacked retaining ring supply to the workpiece is totally eliminated. Another outstanding advantage of the applicator according to the present invention consists in that it permits the insertion of the retaining rings into otherwise almost inaccessible places, as long as a slight tilting movement of the applicator over a small angle, for instance 30°, is possible.

While according to FIG. 2 the applicator is held so that its widest surfaces are horizontal, it is, of course, possible to use the applicator with the widest surfaces thereof vertically when the pin is horizontal.

The applicator 13 shown in FIGS. 7 and 8 represents a modification over the applicator 4 of FIGS. 2–6, inasmuch as the front end of the applicator 13 has not a straight end face throughout its width but has a central portion 14 set back relative to those portions 15 of the end face which are located adjacent the side edges of the widest surfaces of the applicator 13. The set back portion 14 preferably forms an arc conforming to the curvature of the rear portion 2*a* of the retaining ring 2. The front end face of the tongue for engagement with the respective foremost retaining ring is preferably but not necessarily, slightly concave in conformity with the retaining ring rear curvature similar to the front end face of the tongue 8 described in connection with FIGS. 2–6. As will be clearly seen from FIGS. 7 and 8 in the position shown therein of the foremost retaining ring, the latter is laterally supported by the slot portions 16, 16*a* and 17, 17*a* forming projecting arms while otherwise the foremost retaining ring is fully exposed and ready for insertion into a corresponding slot of a workpiece.

It is, of course, to be understood that the applicator of FIGS. 7 and 8 of which only the front portion is shown is likewise provided with one or more windows similar to the windows 7 of FIGS. 2 and 3. It is furthermore to be understood that while FIGS. 2 and 3 show windows on one side of the applicator only, on the opposite side there may also be provided one or more windows offset to the windows on the first mentioned side.

Finally, it is to be understood that the present invention is, by no means, limited to the specific showing in the drawing, but also comprises any modifications within the scope of the appended claims.

What I claim is:

1. An applicator for receiving a one-piece flat strip of integrally interconnected retaining rings and applying therefrom a single retaining ring at a time to a groove in a workpiece, which comprises:

a long flat sheath having a flat passage therethrough extending in the longitudinal direction of the sheath and being dimensioned to slideably receive and guide therethrough a one-piece flat strip of integrally interconnected retaining rings;

said sheath having two side walls and two transverse walls interconnecting said side walls and being provided with at least one window for manual access to the interior of said sheath;

said sheath having front edges forming the dispensing end with an outlet opening of nearly rectangular cross section;

said dispensing end having two outwardly projecting arms extending in the longitudinal direction of said sheath and being arranged adjacent to said side walls while being spaced from each other in the transverse direction of said sheath;

each of said projecting arms having an outer free end and an inner end integral with said sheath;

said dispensing end including a section which is curved in conformity with the outer curved shape of said retaining rings and which interconnects said inner ends of said arms and is offset relative to said outer ends of said arms in the longitudinal direction of said sheath; and a tongue-shaped spring having one end connected to an area of said transverse walls while being spaced from said outlet opening in the direction of the longitudinal extension of said sheath and having its other end as a free end located at said outlet opening and normally extending into the advancing path of a retaining strip to be passed through said passage and said outlet opening, said other free spring end being curved in corresponding configuration to the said curved section of the dispensing end and being movable out of said path by a push from the inside of said passage onto said other free spring end to thereby allow the dispensing of a retaining ring from a retaining ring strip in the longitudinal direction of said sheath when said last mentioned ring has been passed through said passage, said other spring end when occupying said normal position barring movement of a retaining ring from the outside area in front of said outlet opening through the latter into said passage.

* * * * *